US007293807B2

(12) United States Patent
Hemping

(10) Patent No.: US 7,293,807 B2
(45) Date of Patent: Nov. 13, 2007

(54) DOOR HANDLE ASSEMBLY

(75) Inventor: Kelly E. Hemping, Altoona, IA (US)

(73) Assignee: EMCO Enterprises, Inc., Des Moines, IA (US)

( * ) Notice: Subject to any disclaimer, the term of this patent is extended or adjusted under 35 U.S.C. 154(b) by 136 days.

(21) Appl. No.: 10/377,306

(22) Filed: Feb. 28, 2003

(65) Prior Publication Data

US 2004/0169379 A1 Sep. 2, 2004

(51) Int. Cl.
*E05B 3/00* (2006.01)

(52) U.S. Cl. ..... 292/336.3; 292/169.14

(58) Field of Classification Search ..... 292/336.3, 292/169.14, 169.15
See application file for complete search history.

(56) References Cited

U.S. PATENT DOCUMENTS

| | | | | |
|---|---|---|---|---|
| 1,684,499 | A | 9/1928 | Mayer | |
| 2,141,659 | A | 12/1938 | Nehls | 292/347 |
| 2,278,534 | A | 4/1942 | Dickason | 292/347 |
| 2,573,028 | A | 10/1951 | Kramer | 292/356 |
| 2,605,648 | A | 8/1952 | Sanderlin et al. | 74/528 |
| 3,147,608 | A | 9/1964 | Turner et al. | 70/146 |
| 4,072,331 | A | 2/1978 | Butterfield et al. | 292/173 |
| 4,480,451 | A | 11/1984 | Fujiya | 70/92 |
| 4,632,439 | A | 12/1986 | Miller | 292/166 |
| 4,864,835 | A | 9/1989 | Wartian | 70/107 |
| 5,460,419 | A | 10/1995 | Castoldi | 292/336.3 |
| 5,520,427 | A * | 5/1996 | Mader | 292/336.3 |
| 5,609,372 | A | 3/1997 | Ponelle | 292/200 |
| 5,664,816 | A | 9/1997 | Nigro, Jr. et al. | 292/336.3 |
| 5,676,409 | A * | 10/1997 | Trammell, Jr. | 292/336.3 |
| 5,829,801 | A | 11/1998 | Tindall | 292/336.3 |
| RE36,209 | E | 5/1999 | Walls | 292/173 |
| 5,904,232 | A | 5/1999 | Shen | 192/69.62 |
| 6,021,654 | A * | 2/2000 | McCaa | 70/149 |
| 6,282,753 | B1 | 9/2001 | Hochmuth | 16/412 |
| 6,302,453 | B1 | 10/2001 | Norton | 292/169.21 |
| 6,481,253 | B1 | 11/2002 | Fan | 70/107 |
| 6,490,896 | B2 | 12/2002 | Segawa | 70/208 |
| 6,491,327 | B1 | 12/2002 | Fan | 292/165 |
| 6,527,314 | B2 * | 3/2003 | Brown | 292/336.3 |
| 6,669,245 | B2 * | 12/2003 | Ruano Aramburu et al. | 292/169.14 |
| 2002/0113445 | A1 * | 8/2002 | Brown | 292/336.3 |

* cited by examiner

*Primary Examiner*—Gary Estremsky
(74) *Attorney, Agent, or Firm*—Womble Carlyle Sandridge & Rice, PLLC

(57) ABSTRACT

A door handle assembly having a latch bolt mechanism and a retaining mechanism positioned within a housing. A shaft having a lever handle is positioned within a through hole in the latch bolt mechanism. The lever handle can be rotated in a first direction from a first position to a second position, and in a second opposite direction from the first position to a third position to provide access to an area of a door panel otherwise obstructed by the lever handle.

13 Claims, 12 Drawing Sheets

DOOR HANDLE ASSEMBLY

TECHNICAL FIELD

This disclosure relates generally to handle devices for doors. More particularly, this disclosure relates to a door handle assembly having a lever handle.

BACKGROUND

A wide variety of door handle styles and systems exists. One style of door handle includes a lever-type handle. Lever-type handles commonly include an outside lever handle mounted on an outside of a door panel, an inside lever handle mounted on an inside of the door panel, and a latch bolt mechanism mounted inside the door panel. The latch bolt mechanism is interconnected to the lever handle, which in combination controls the opening and closing of the door. To open the door, the lever handle is typically rotated or turned in a downward direction. The lever handle generally rotates no more than 90 degrees relative to an initial horizontal orientation.

Conventional lever handle designs include a lever that extends horizontally toward the center of a doorframe. In some designs, the doorframe includes a window. The lever of the handle assembly can extend across the window. In maintaining the appearance of the door panel or the window, a person often has to work around the extension portion of the handle. In general, improvement has been sought with respect to such configurations, generally to better accommodate ease of cleaning and maintenance of a door having a lever handle assembly.

SUMMARY

One aspect of the present disclosure relates to a door handle assembly including a housing, a first lever handle mounted to a shaft, and a latching mechanism. The first lever handle is positioned on the end of the shaft, the shaft being positioned within a through hole defined by the latching mechanism. The first lever handle is selectively rotatable from a first position to a second position by rotating the first lever handle in a first direction, and from the first position to a third position by rotating the first lever handle in a second opposite direction.

Another aspect of the present disclosure relates to a door including a handle assembly mounted to a door panel. The handle assembly includes a retaining mechanism and a latch bolt mechanism. A handle extension is interconnected to the latch bolt mechanism and partially extends across an adjacent area of the door panel when the handle extension is in a first position. The handle extension is configured to rotate from the first position to a retained position away from the adjacent area of the door panel to provide access to the adjacent area of the door panel.

Still another aspect of the present disclosure relates to a method of accessing an area of a door panel by providing a door panel having a handle assembly, rotating the handle assembly, retaining the handle assembly in a third position, and releasing the handle assembly. While the handle assembly is released and in the third position, the area of the door panel that underlies the handles assembly, wherein in a first position, can be accessed. The method further includes returning the handle assembly to the first position.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
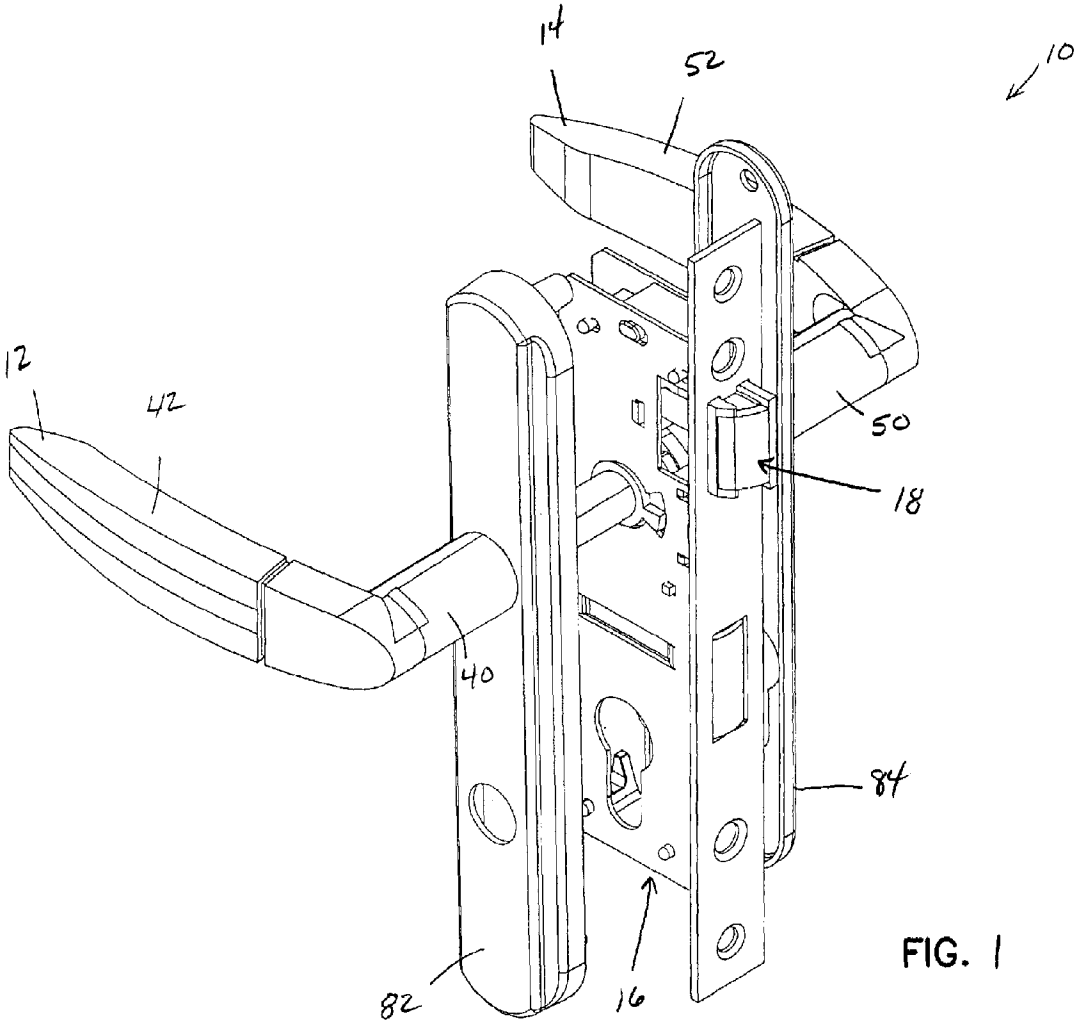
FIG. 1 is a perspective view of one embodiment of the door handle assembly in accord with the principles disclosed.
Figure 2:
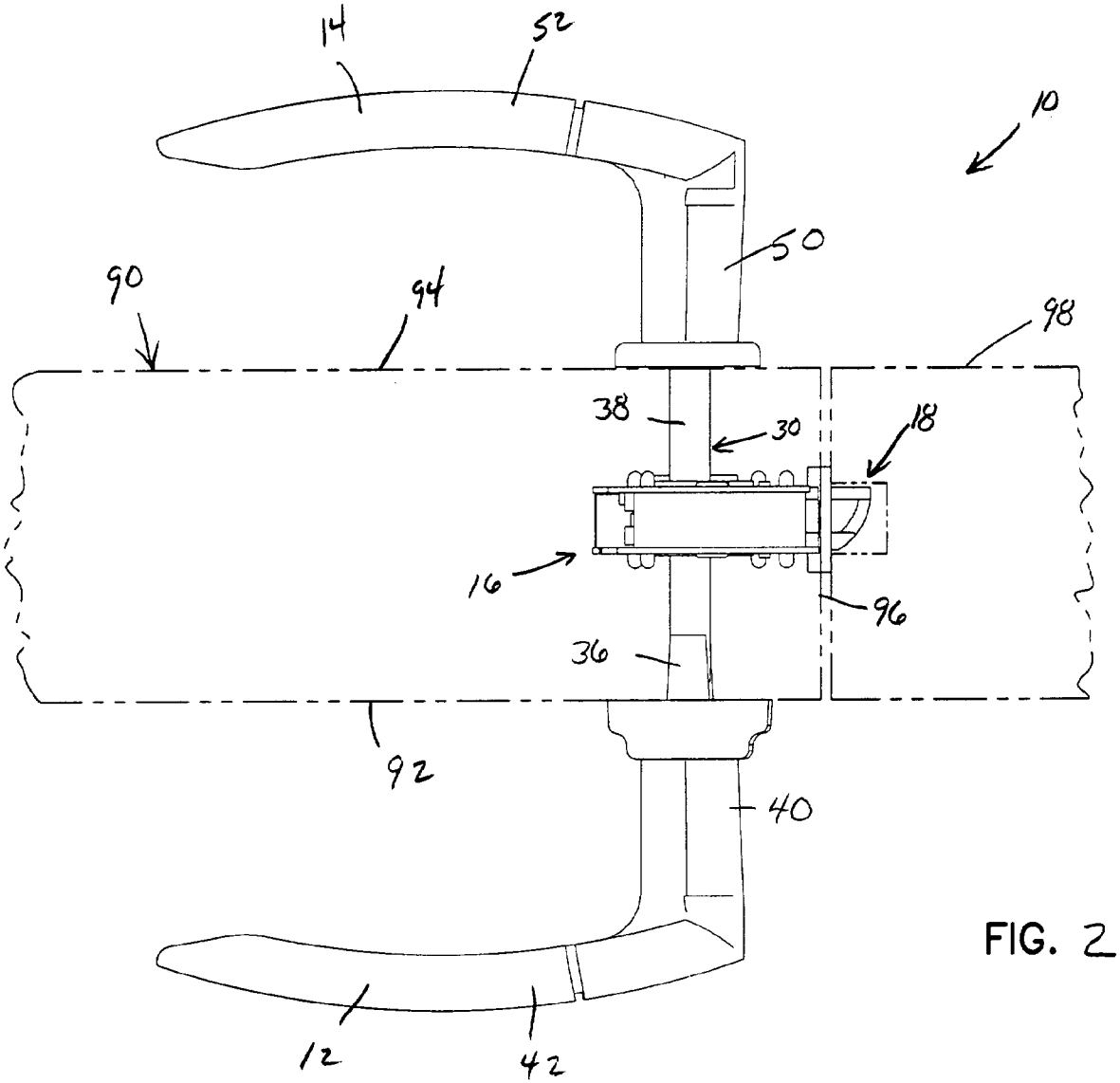
FIG. 2 is a top plan view of the door handle assembly of FIG. 1, shown in relations to a door panel and doorframe.
Figure 3:
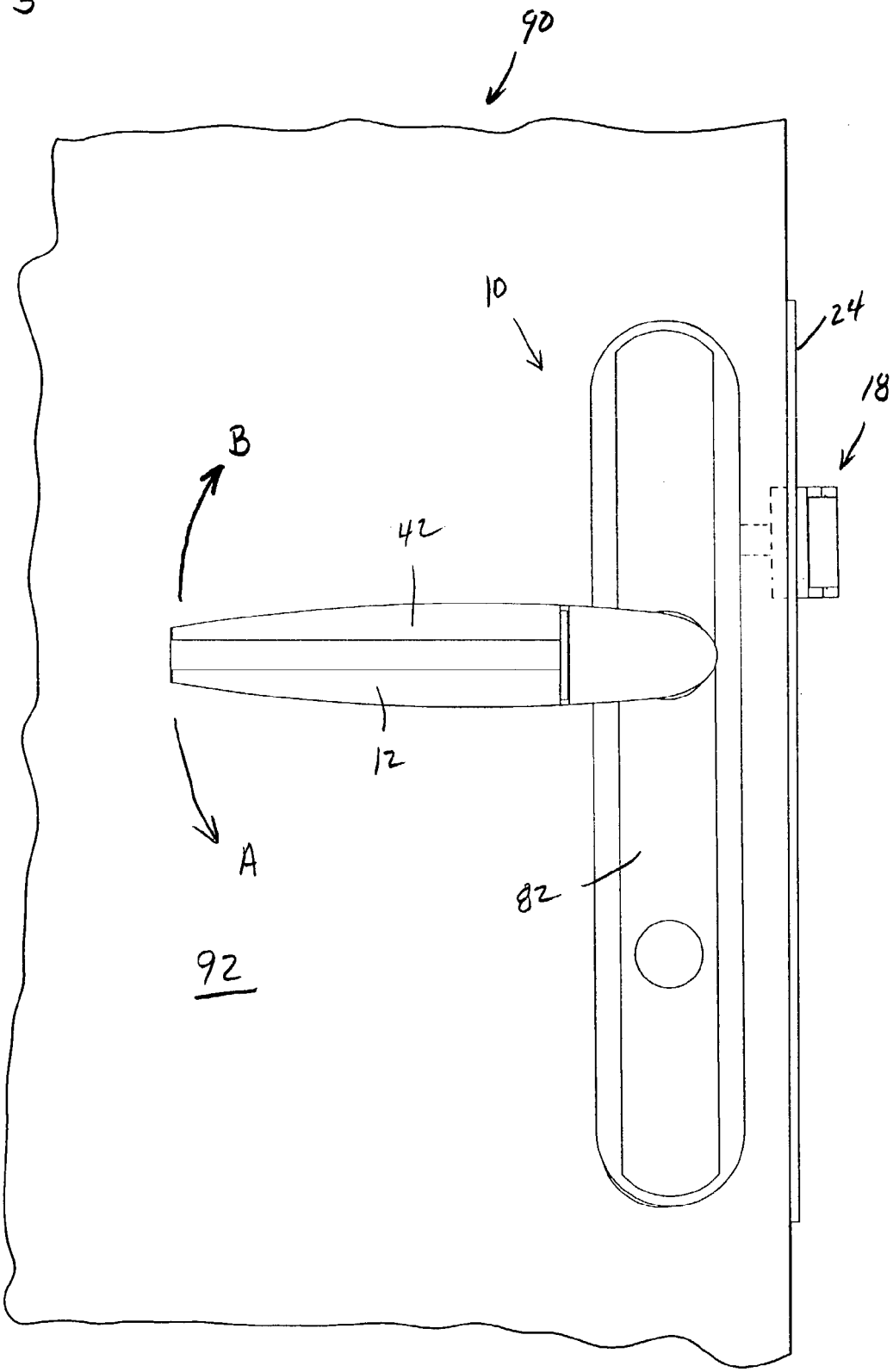
FIG. 3 is a side elevational view of the door handle assembly of FIG. 1, shown assembled within a door panel and positioned in a first position.

Referring to FIGS. 1–3, one embodiment of a handle assembly 10 according to the present disclosure is illustrated. The handle assembly 10 is configured to be mounted on a door or door panel 90 having an first side 92, a second side 94, and a lateral side 96 interconnecting the first and second sides 92, 94. The door panel 90 is generally configured for mounting with a doorframe 98. A portion of the handle assembly 10 is typically mounted within a slot (not shown) formed within the lateral side 96 of the door panel 90. It is contemplated that the handle assembly 10 can be used in constructions and applications other than a door panel in accord with the principles disclosed.

The handle assembly 10 generally includes an outside lever member 12, inside lever member 14, a housing or lock case 16, and a latch bolt mechanism 18. The term "outside" and "inside" is meant to respectively associate the lever members with the first side 92 and the second side 94 of the door panel 90. The terms "outside" and "inside" may or may not relate to an inside environment and an outside environment.

Figure 4:
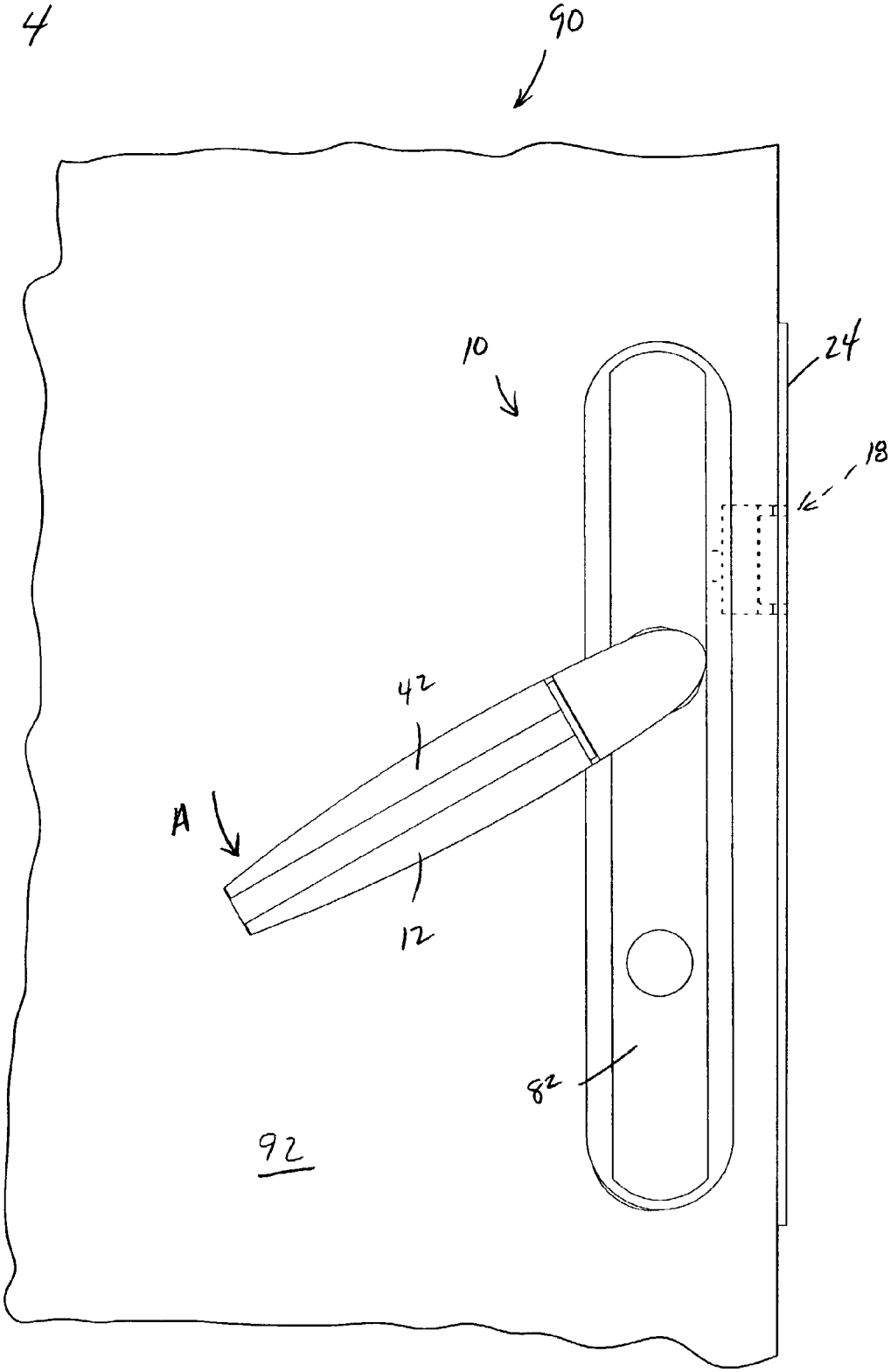
FIG. 4 is a side elevational view of the door handle assembly of FIG. 3, positioned in a second position.

In normal use, one of the outside and inside lever members 12, 14 is rotated in a first direction A (represented by arrow A) from a first position (FIG. 3) to a second position (FIG. 4) to open the door panel 90. Upon release of the handle assembly 10, the lever members 12, 14 automatically return from the second position to the first position. The movement of the lever members 12, 14 between the first and second positions is generally for the purpose of operating the door panel 90; e.g., for opening and closing the door panel 90.

Typically, the first position (FIG. 3) of the lever members is a generally horizontal position. That is, the elongated portion of the lever member extends horizontally in relation to the ground. The first position can also be referred to as a latched position whereby the handle assembly 10 is latched or engaged with a doorframe 98 when the door panel 90 is in a closed position within the doorframe (FIG. 2).

The second position (FIG. 4) is generally a non-horizontal position and can also be referred to as an unlatched position. That is, as the handle assembly 10 is rotated in the first direction A, the latch bolt mechanism 18 of the handle assembly disengages from the doorframe 98 so that the door panel 90 can be opened.

Figure 5:
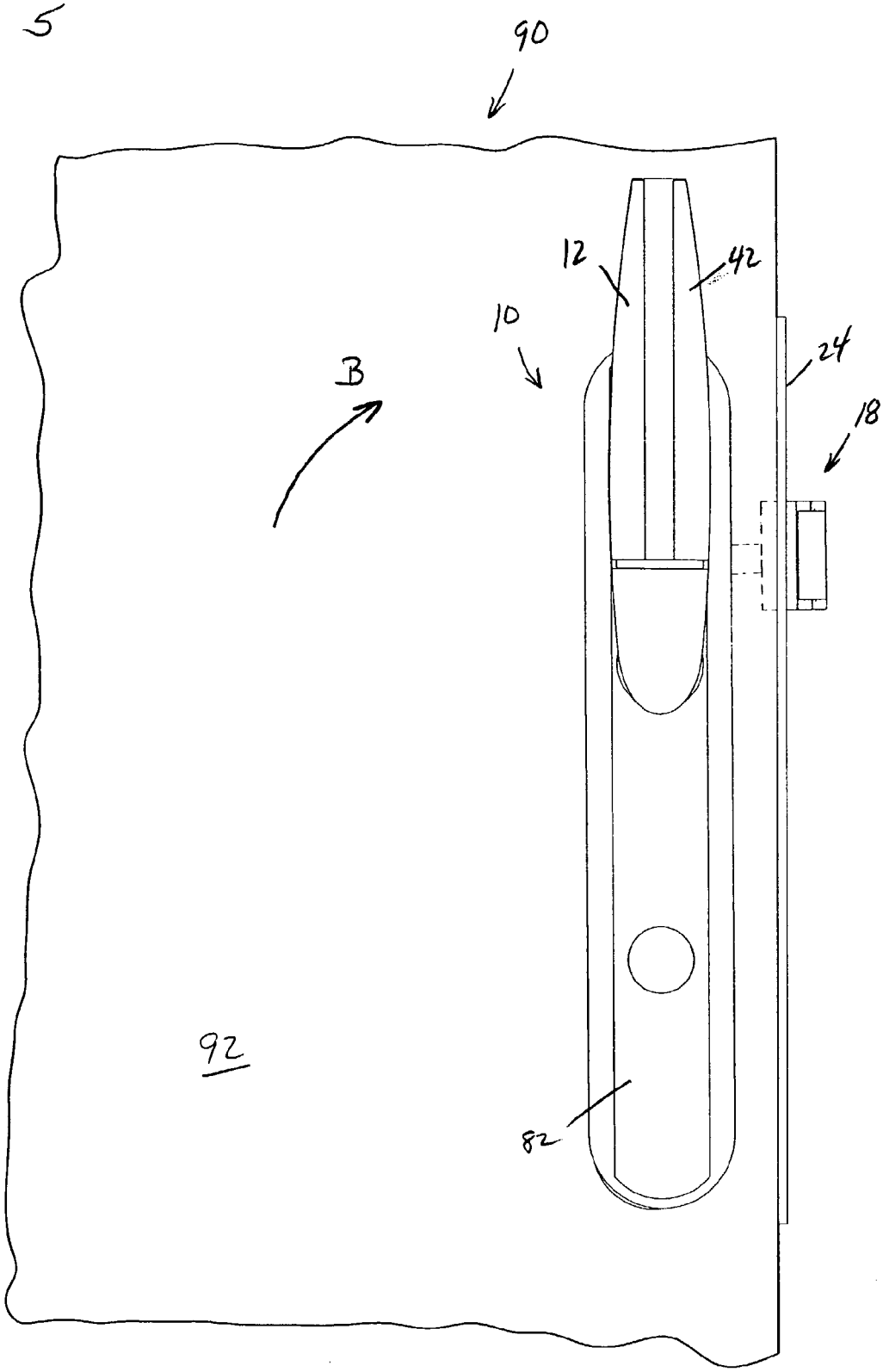
FIG. 5 is a side elevational view of the door handle assembly of FIG. 3, positioned in a third position.

As will be discussed in greater detail hereinafter, the handle assembly 10 can also be rotated in a second direction B (represented by arrow B) to a third position (FIG. 5). The second direction B is opposite the first direction A. The third position of the lever members is also generally a non-horizontal position. Typically the third position is also a retained or latched-and-retained position. What is meant by "retained" is that the lever members 12, 14 are secured, retained or held in the third position without assistance from the user. That is, the user may release his grip from the lever member and the lever member will remain in the third or retained position. The lever members typically remain in the third position, hands-free of the user, until the user selectively applies a releasing force to move the lever member to another position.

Rotating the handle assembly to the third position provides access to an adjacent area of the door panel. The adjacent area of the door panel includes the area that is otherwise obstructed by the lever members 12, 14 in either of the first and second position, or the area underlying the lever members when the handle assembly is at or between the first and second positions. The movement of the lever members 12, 14 between the first and third positions is generally for purposes other than operating the door panel 90, or non-operational purposes. Non-operational purposes include, for example, moving the lever members to the third position to permit obstruction-free access to the adjacent area when maintaining or cleaning the adjacent area of the door panel 90, or to permit obstruction-free access to the general area when removing or installing storm windows or window screens in the door panel.

In the illustrated embodiment, the first, second, and third positions lie in the same plane. In particular, each of the lever members 12, 14 of the handle assembly is configured to rotate from the first position to either of the second and third positions along a single plane. The single plane is generally parallel to the both the first and second sides 92, 94 of the door panel 90.

Referring to FIGS. 1 and 2, each of the lever members 12, 14 of the handle assembly 10 is similarly constructed, although it is contemplated that the lever members can include structural features different from one another. The outside lever member 12 includes a mounting portion 40 and a lever extension 42. In the illustrated embodiment, the lever extension 42 is oriented to extend generally perpendicular to the mounting portion 40. Similarly, the inside lever member 14 includes a mounting portion 50 and a lever extension 52 that is oriented to extend generally perpendicular to the mounting portion 40. Typically, the lever extensions 42, 52 are configured so that a user can comfortably grip the lever extension to operate the door 90.

Figure 6:
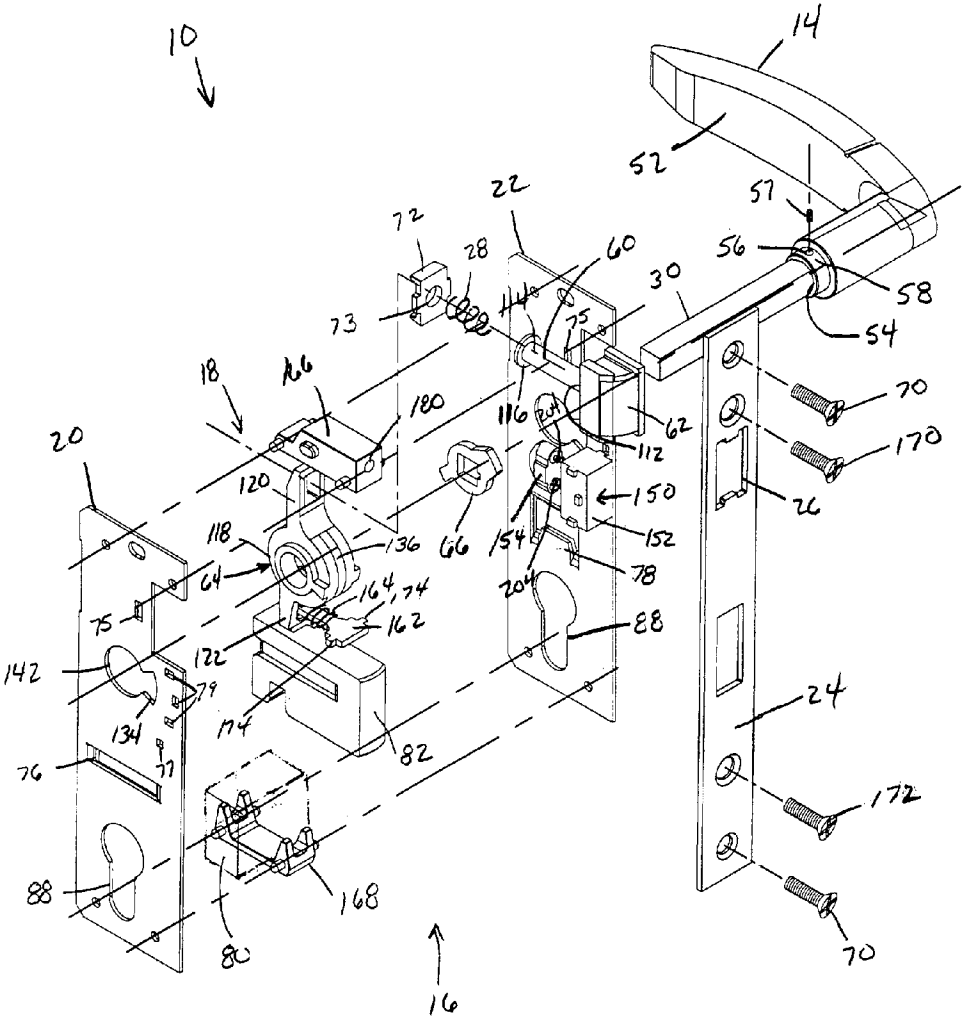
FIG. 6 is an exploded assembly view of the door handle assembly of FIG. 1.

Referring now to FIG. 6, the handle assembly 10 is shown in an exploded view. Only the inside lever member 14 is illustrated for purposes of clarity. The following description however can be applied to both lever members 12, 14. Each of the mounting portions 40, 50 of the lever members 12, 14 include an aperture 54 extending at least partially through the mounting portion 40, 50 of the lever member. The aperture 54 is sized and configured for receipt of a spindle or shaft 30. In the illustrated embodiment, a transverse threaded hole 56 extends from an outer surface 58 of the mounting portion 40, 50 into the aperture 54. A set screw 57 is used to couple the lever members 12, 14 to the shaft 30. Other coupling configurations, such as snap rings, rivets, locking notches, keyways, or adhesives, can be used to couple the lever member to the shaft.

Figure 7:
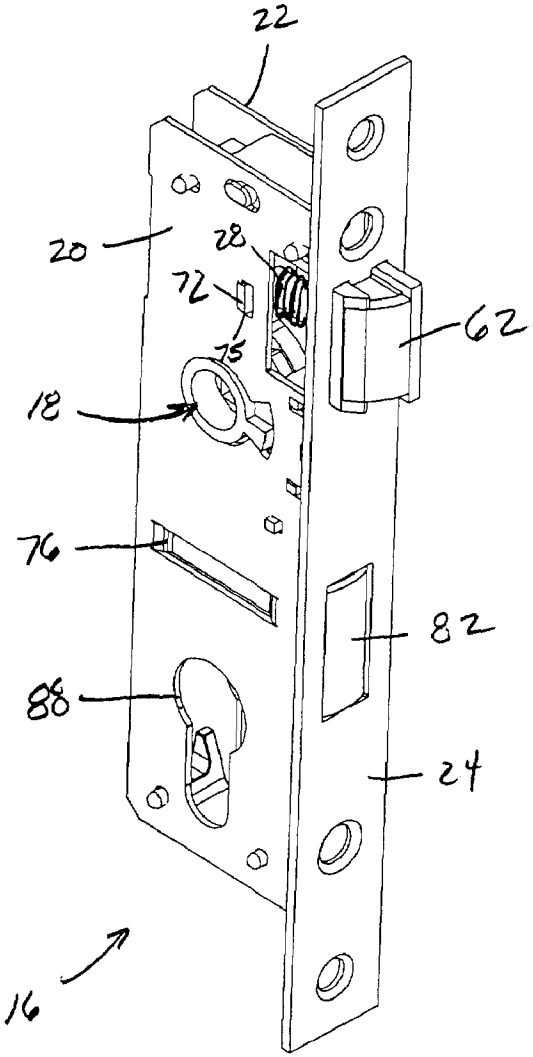
FIG. 7 is a perspective view of one embodiment of a housing of the door handle assembly of FIG. 1.

Referring now to FIGS. 6 and 7, the housing or lock case 16 of the handle assembly 10 includes first and second plate constructions 20, 22 and a face plate 24. Upper and lower structure members 166, 168 are positioned between the plate constructions 20, 22 and maintain each of the plate constructions 20, 22 in a generally parallel relation to one another. The upper structure member 166 includes a threaded hole 180. A conventional fastener 170 threaded within the threaded hole 180 is used to secure the upper half of the face plate 24 to the upper structure member 166.

The latch bolt or latching mechanism 18 of the handle assembly 10 is position between the first and second plate constructions 20, 22 adjacent to an opening 26 in the face plate 24. In the illustrated embodiment, a key cylinder 80 (schematically represented in phantom only in FIG. 6) is positioned adjacent to key cylinder apertures 88 formed in the first and second plate constructions 20, 22. A dead lock 82 is positioned in operable relation with the key cylinder 80. The dead lock 82 is secured within the lock case 16 by attachment structures 76 and 78 formed in the plate constructions 20, 22. The key cylinder 80 and dead lock 82 operate in a conventional manner to lock the door panel 90 in the doorframe 98. As shown in FIG. 6, a second conventional fastener 172 can be used to secure the lower half of the face plate 24 into relation with a key cylinder 80 positioned within the lock case 16.

Still referring to FIG. 6, the latch bolt mechanism 18 includes a latch structure 64, a center hub or cam piece 66, and a latch bolt 60. The latch structure 64 and the cam piece 66 are rotatable. The latch structure 64 rotates in the first direction A when the lever members 12, 14 are rotated in the first direction A. The cam piece 66 is configured to rotate in both the first direction A and the second direction B when the lever members 12, 14 are rotated in either the first direction or the second direction. In other words, the cam piece 66 is configured to rotate independently of the latch structure 64 when rotated in the second direction B.

The latch bolt 60 has a first end 112 and a second end 114. A latch head 62 is positioned at the first end 112 of the latch bolt 60. The latch bolt 60 and latch head 62 are movable between an extended position (e.g. FIGS. 1 and 3) and a retracted position (e.g. FIG. 4). In the extended position, the latch head 62 projects through the opening 26 in the face plate 24. In the retracted position, the latch head 62 is retracted toward the lock case 16.

A fixed element 72 (FIG. 6) is attached to the first and second construction plates 20, 22 (FIG. 7) at locations 75. The fixed element 72 includes a hole 73 through which the latch bolt 60 extends. A spring 28 is positioned between the fixed element 72 and the latch head 62 to bias the latch head 62 toward the extended position (FIG. 14).

Figure 8:
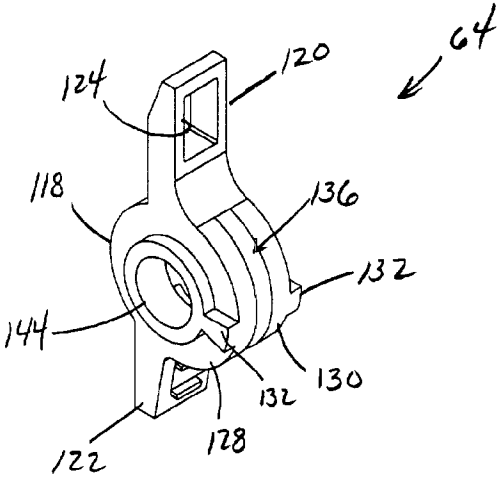
FIG. 8 is a perspective view of one embodiment of a latch structure of the door handle assembly of FIG. 1, in accord with the principles disclosed.
Figure 9:
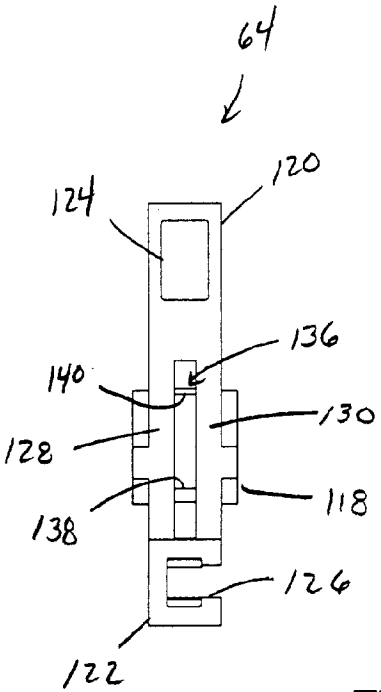
FIG. 9 is a front elevation view of the latch structure of FIG. 8.
Figure 10:
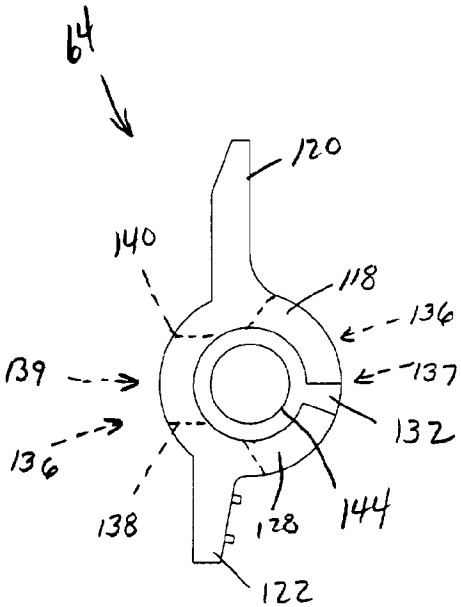
FIG. 10 is a side elevational view of the latch structure of FIG. 8.

Referring now to FIGS. 8–10, the latch structure 64 includes a main portion 118 and first and second arms 120, 122 that extend outward from the main portion 118. Each of the first and second arms 120, 122 includes an opening or slot 124, 126. As shown in FIG. 14, the second end 114 of the latch bolt 60 is positioned within the opening 124 of the first arm 120 of the latch structure 64. A stop 116 is positioned at the second end 114 of the latch bolt to retain the latch bolt 60 within the slot 124 of the first arm 120.

Figure 14:
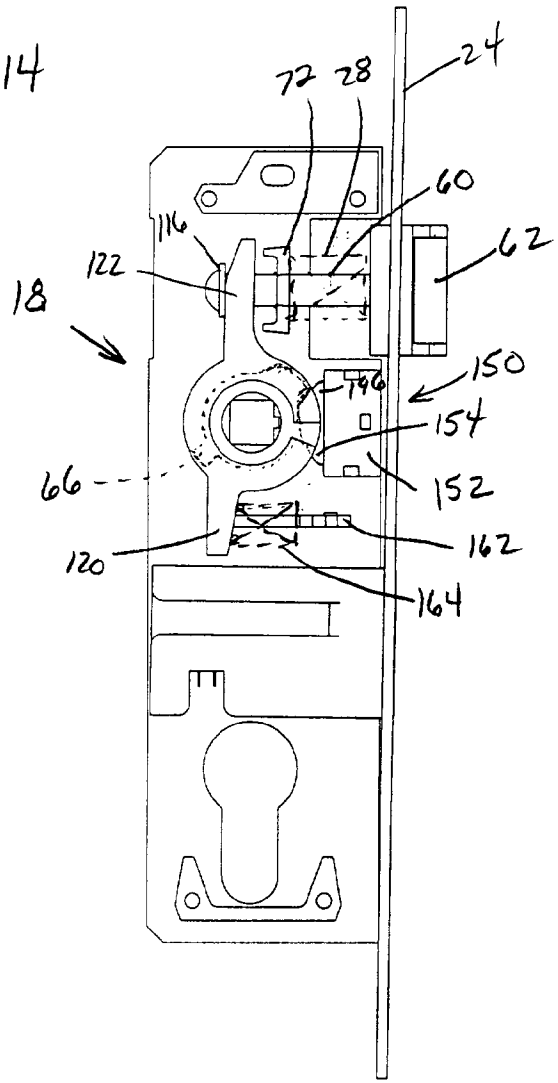
FIG. 14 is a side elevational view of the door handle assembly of FIG. 13, shown in the first position of FIG. 3.

Referring to FIGS. 6 and 14, a finger 162 and return spring 164 are arranged adjacent to the second arm 122 of the main portion 118. The finger 162 has tabs 174 that attached to each of the first and second plate constructions 20, 22 at locations 77 (FIG. 7). When assembled, the finger 162 extends through the slot 126 of the second arm 122 when the second arm is rotated toward the face plate 24, i.e. when the handle assembly 10 is rotated from the first position (FIG. 3) to the second position (FIG. 4) in the first direction A. The return spring 164 acts against the second arm 122 to bias or return the latch structure 64, and thereby the lever members 12, 14, from the second position back to the first position when the lever member 12, 14 is released.

Figure 11:
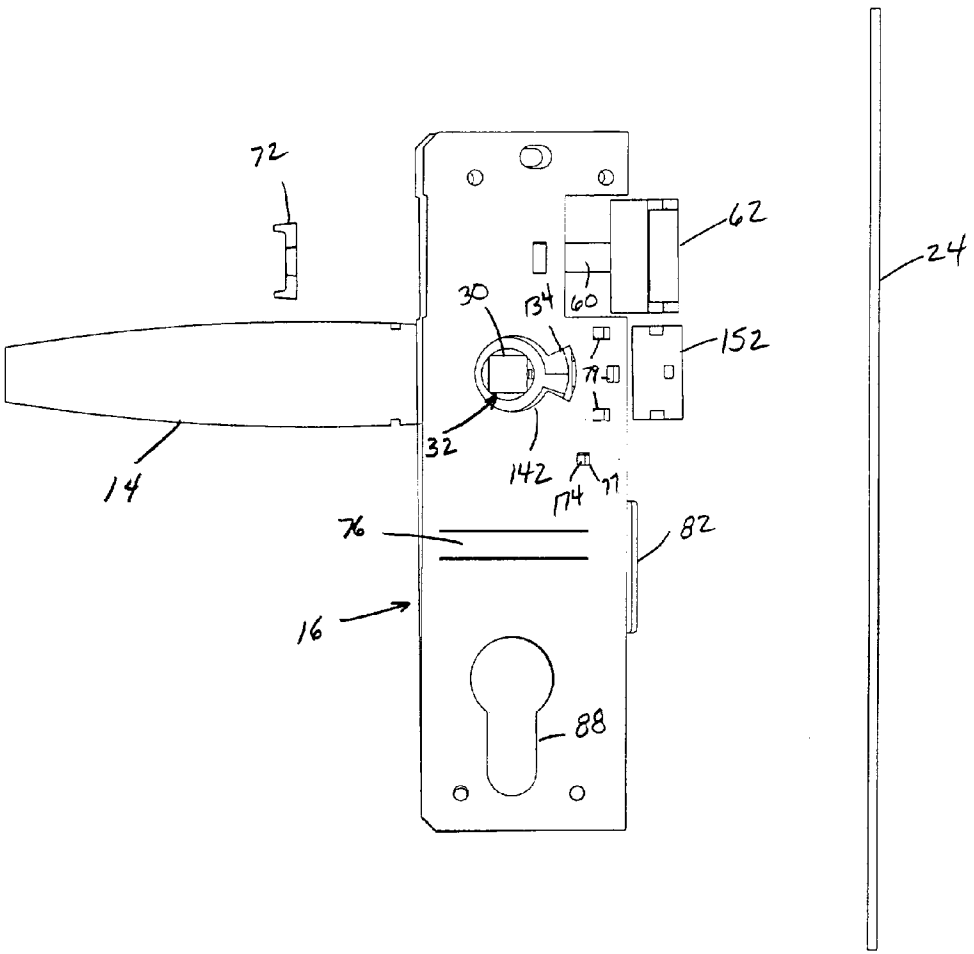
FIG. 11 is a side elevational view of the door handle assembly of FIG. 6, partially assembled.
Figure 12:
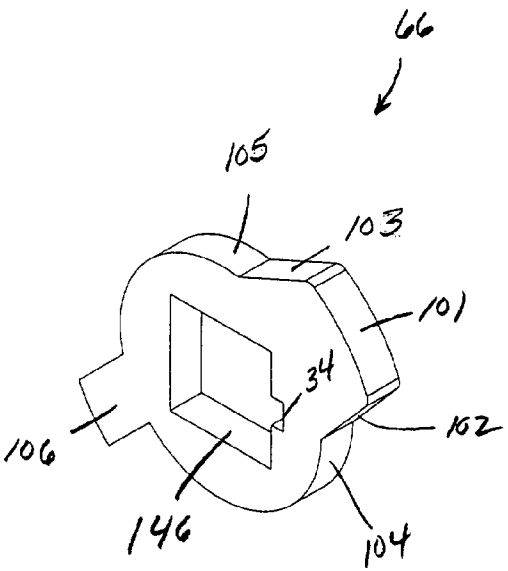
FIG. 12 is a perspective view of one embodiment of a cam piece of the door handle assembly of FIG. 1, in accord with the principles disclosed.

Referring back for FIGS. 8–10, the main portion 118 of the latch structure 64 includes first and second flanges 128, 130 between which the cam piece 66 (FIG. 12) is positioned. Referring to FIGS. 6 and 11, each of the first and second flanges, the cam piece 66, and the first and second plate constructions 20, 22 define a spindle hole or through hole 32 that extends through the lock case 16. In particular, each of the first and second plate constructions includes a clearance hole 142; likewise, the first and second flanges 128, 130 of the main portion 118 include clearance holes 144 (FIGS. 8 and 10). Referring to FIG. 12, the cam piece 66, however, includes an aperture structure 146 configured to drive the latch bolt mechanism 18. In the illustrated embodiment, the aperture structure 146 includes a square aperture configuration.

As shown in FIG. 12, a notch 34 is formed in the aperture structure 146 of the cam piece 66. The notch 34 is provided at a location to assist a user in properly positioning the cam piece 66 during installation of the handle assembly 10. For example, in the illustrated arrangement, the user is requested to position the notch 34 of the spindle hole 32 in the direction of the face plate 24 (FIG. 14) when the handle assembly 10 is installed within the door panel 90. This ensures that the latch mechanism 18 will be properly set to provide rotation in the first direction A to open the door, and to provide rotation in the second direction B to retain the handle assembly 10 in the retained position.

As shown in FIG. 11, the spindle or shaft 30 is operably coupled within the spindle hole 32 such that axial rotation of the shaft 30 results in movement of the latch head 62 of the latch bolt 60 between the extended and retracted positions. In the illustrated embodiment, the shaft 30 has a generally square cross-section corresponding to the aperture structure 146 of the cam piece 66. The shaft has opposite ends 36, 38 (FIG. 2) respectively secured to the mounting portions 40, 50 of the outside and inside lever members 12, 14. In this configuration, rotation of either one of the outside and inside lever members 12, 14 results in movement of the latch head 62 of the latch bolt 60 from the extended position to the retracted position.

The cam piece 66 and the main portion 118 of the latch bolt mechanism 18 rotate in concert with the shaft 30 from the first position to the second position in the first direction A. In the illustrated embodiment, the rotation of the main portion 118 in the first direction is limited by a projection 132 (FIGS. 8–10) formed on the sides of each of the flanges 128, 130. The projections 132 reside with limiting slots 134 (FIG. 11) formed adjacent to the clearance holes 142 in the plate constructions 20, 22. The projections 132 and the limiting slots 134 limit or stop the angular rotation of the main portion 118 of the latch bolt mechanism.

The projections and limiting slots 132, 134 are configured to permit rotation of the main portion 118 of the latch structure 64 a first number of degrees in the first direction A. Preferably the first number of degrees of rotation from the first position to the second position is between 5 and 90 degrees; more preferably the first number of degrees is between about 15 to 40 degrees.

Figure 13:
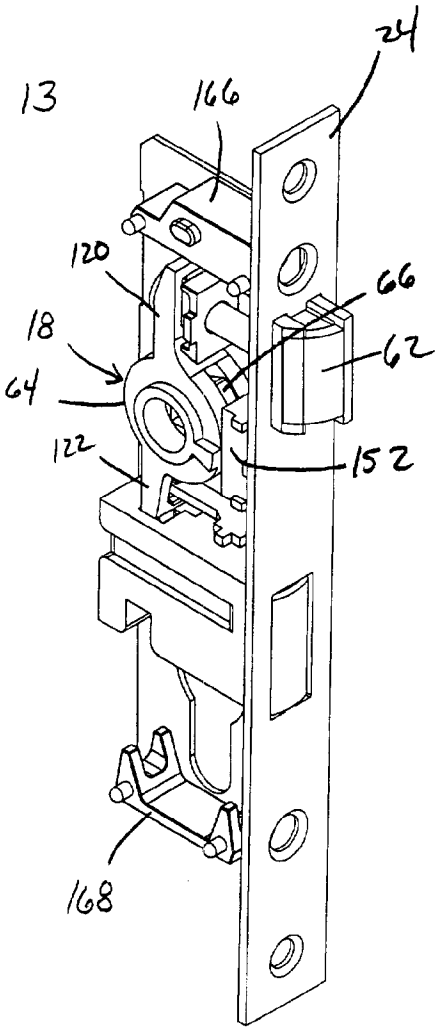
FIG. 13 is a perspective view of the door handle assembly of FIG. 7, shown without a side plate of the housing.

Referring back to FIG. 12, the cam piece 66 includes a first projection 101 having cam first and second surfaces 102, 103, first and second detent regions 104, 105, and a second projection 106. When assembled, the cam piece 66 is positioned within a slot 136 (FIG. 8) formed between the first and second flanges 128, 130 of the latch structure 64. In particular, the first projection 101 is positioned within a front portion 137 of the slot 136 and the second projection 106 is positioned within a rear portion 139 of the slot 136 (FIGS. 10, 13, and 14). When the lever members are in the first position, as shown in FIG. 3, the second projection 106 is located adjacent to a lower end 138 of the slot (shown in FIGS. 10 and 14). When the cam piece 66 is rotated in the first direction A, the projection 106 rotationally drives against the lower end 138 of the slot 136 to rotate the main body 118. As the main body 118 rotates, the first arm 120 rotates away from the face plate 24 and draws latch bolt 60 and latch head 62 into the retracted position.

When the handle assembly 10 is in the first position, the latch bolt head 62 is in the extended position. In use, the handle assembly 10 rotates from the first position to the second position to place the latch bolt head 62 in the retracted position so that the door panel 90 can be opened or closed.

Referring back to FIG. 3, in the first position, the lever members 12, 14 generally extend across at least a portion of the door panel 90. That is, the lever members 12, 14 are typically horizontally oriented and extend across the adjacent area of the door panel 90. The adjacent area underlying the lever members 12, 14 can be difficult to access. In accord with the principles disclosed, lever members 12, 14 of the handle assembly 10 are configured to rotate to the third position to provide access to the adjacent area of the door panel 90. In the preferred embodiment, the lever members 12, 14 are moveable from the first position to the third position by rotating the lever members 12, 14, in the second direction B opposite the first direction A.

Figure 15:
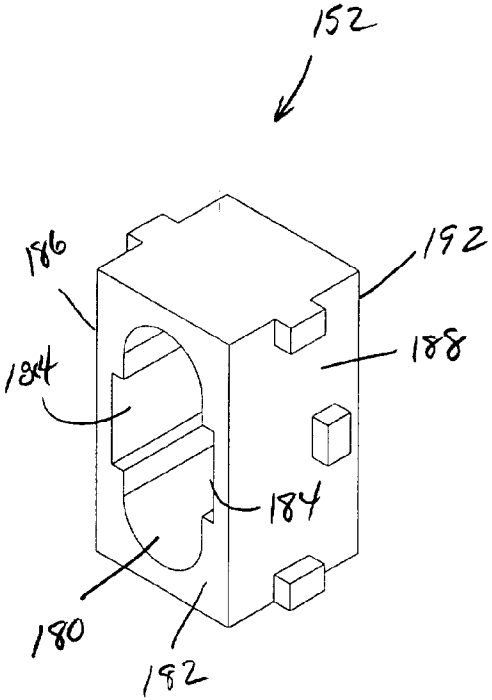
FIG. 15 is a perspective view of one embodiment of a retaining housing of the door handle assembly of FIG. 1, in accord with the principles disclosed.

Referring to FIG. 14, the handle assembly 10 of the present disclosure includes a retaining mechanism 150. The retaining mechanism 150 is operably positioned adjacent to the latch bolt mechanism 18. The retaining mechanism 150 functions to retain the lever members 12, 14 in the retained position. The retaining mechanism 150 includes a retaining housing 152 (FIGS. 15 and 16) and a moveable retaining catch 154 (FIG. 17).

Figure 16:
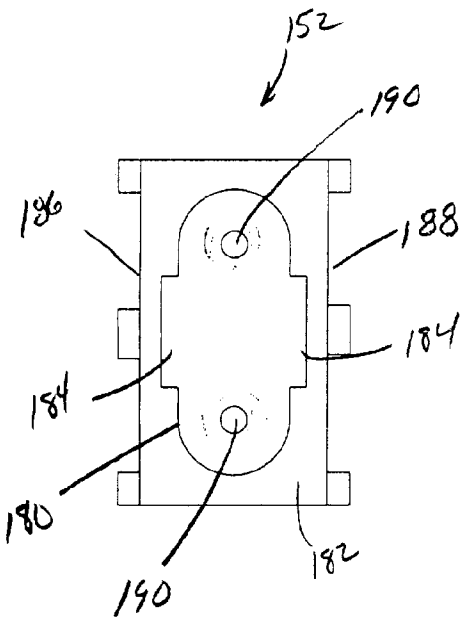
FIG. 16 is a front elevational view of the retaining housing of FIG. 15.

The retaining housing 152 of the retaining mechanism 150 includes an opening 180. The opening 180 is formed in the front wall 182 of the housing 152 and defines channels 184 that extend along sidewalls 186, 188 of the housing. As shown in FIG. 16, guides 190 extend from a backwall 192 of the housing within the opening 180. The retaining housing 152 is attached to each of the first and second plate constructions 20, 22 at locations 79 (FIG. 11).

Figure 17:
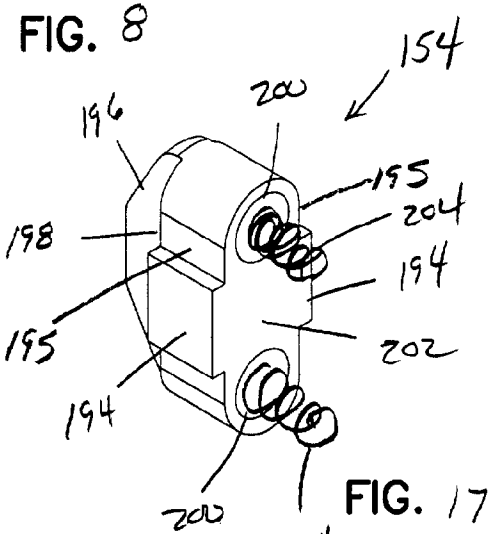
FIG. 17 is a perspective view of one embodiment of a retaining catch of the door handle assembly of FIG. 1, in accord with the principles disclosed.

The moveable retaining catch 154, shown in FIG. 17, is sized and configured for receipt within the opening 180 of the retaining housing 152. In the illustrated embodiment, the retaining catch 154 includes rails 194 extending from sides 195 of the catch 154 that correspond to the channels 184 formed in the housing 152. The channels 184 and rails 194 assist in positioning the retaining catch 154 within the housing 152. The retaining catch 154 also includes a detent extension 196 extending outward from a first side 198 of the catch 154 and at least one aperture 200 formed on a second side 202 of the catch 154. In the illustrated embodiment, two apertures 200 are formed on the second side 202 of the retaining catch 154.

Each of the apertures 200 is sized and configured for receipt of a spring 204. The springs 204 and the retaining catch 154 are inserted within the opening 180 of the housing 152. The springs 204 are maintained in proper position during operation by the configuration of the apertures 200 and the guides 190 of the housing 152.

Figure 18:
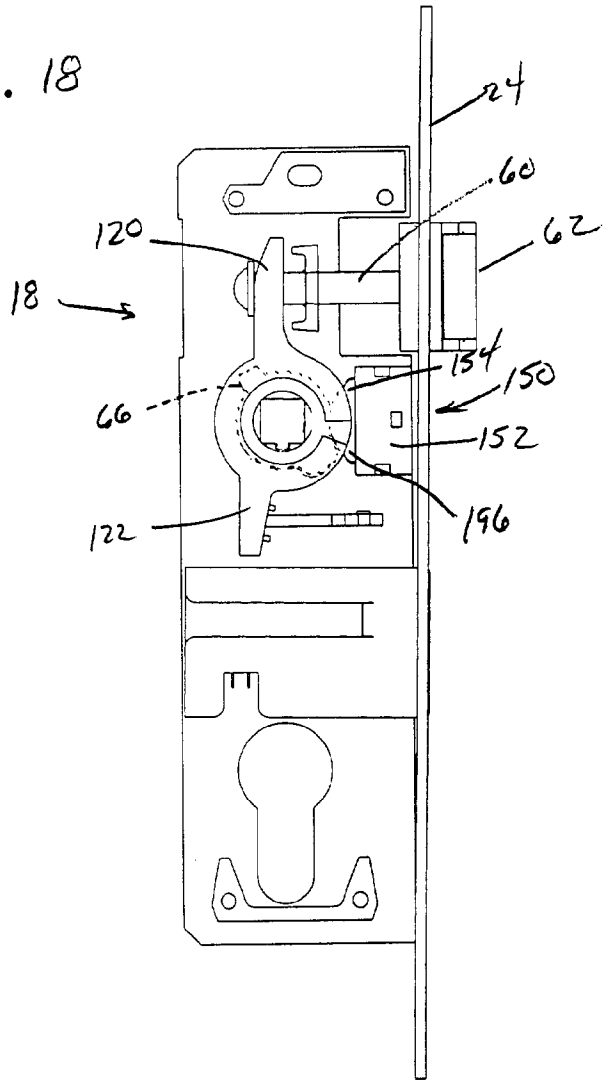
FIG. 18 is a side elevational view of the door handle assembly of FIG. 14, shown in the third position of FIG. 5.

Referring to FIG. 14, when the handle assembly is in the first position (FIG. 3), the detent extension 196 of the retaining catch 154 in positioned adjacent to the first detent region 104 of the cam piece 66 (FIG. 12). When the cam piece 66 is rotated from the first position to the third position, the detent extension 196 of the moveable retaining catch 154 rides along the first cam surface 102 of the first projection 101. The engagement of the cam surface 102 and the detent extension 196 forces the retaining catch 154 against the springs 204. The retaining catch 154 is forced and moved farther within the opening 180 of the housing as the cam piece 66 rotates. Upon reaching the third position, as shown in FIG. 18, the first projection 101 is rotated to a position wherein the detent extension 196 is adjacent to the second detent region 105 of the cam piece 66. The springs 204 are arranged to bias the detent extension 196 of the retaining catch 154 into the detent region 105 of the cam piece 66 to retain the cam piece in the third position, and thereby retain the lever members 12, 14, in the third or retained position.

The lever members are retained or held in the third position even upon release of the lever member 12, 14. That is, a user may selectively position the lever members 12, 14 in the retained position and then release the lever members without the lever members automatically returning to the first position.

The rotation of the cam piece 66 in the second direction B, from the first position to the third position, is limited by the projection 106 of the cam piece 66. In particular, the projection 106 rotates in the second direction B to contact an upper end 140 (FIG. 10) of the slot 136 of the main portion 118 and stop or limit rotation of the cam piece 66. In the illustrated embodiment, the cam piece 66 is configured rotate a second number of degrees sufficient to move the lever members 12, 14 so that the adjacent area of the door panel 90 can be accessed. Typically, the second number of degrees of rotation in the second direction B is greater than the first number of degrees of rotation in the first direction A. Preferably, the second number of degrees of rotation from the first position to the third position is between 70 and 120 degrees; more preferably the second number of degrees is between about 85 and 95 degrees.

The retaining mechanism 150 is configures so that the lever members 12, 14 are easily returned from the third position to the first position. A user need only apply a sufficient return force on the lever members 12, 14 so that the second cam surface 103 of the cam piece 66 slidably contacts the detent extension 196 of the moveably retaining catch 154. As the cam piece rotates, the retaining catch 154 is forced against the springs 204 and moves toward the retaining housing 152. When the lever members 12, 14 reach the first position, the detent extension 196 of the retaining catch 154 is then biased back into the first detent region 104 of the cam piece 66.

In one embodiment, the handle assembly 10 is configured such that the user experiences a snap or click when the lever member 12, 14 is rotated into the third position, or when rotated into the first position from the third position. This feature provides an indication to the user that that lever member is either properly seated and retained in the third position, or is properly position at the first position for normal use in operating the door. In the disclosed arrangement, the indicating snap or clip is effected by the retaining catch 154 moving into engagement with one of the detent regions 104, 105 of the cam piece 66.

The handle assembly 10 can be used on either a left-hinged or right-hinged door. In particular, the configuration of the door level handle 10 can be switched from a left-hinged door to a right-hinged door, or vise versa, by removing the face plate 24 from the lock case 16 and rotating the latch head 62 of the latch bolt 60 to a left facing position or a right facing position. The illustrated embodiment is shown in a right facing configuration for use on a right-hinged door.

In assembling and installing the handle assembly 10, the lock case 16 and the face plate 24 are first secured within the door panel 90 with fasteners 70 (FIG. 6). First and second trim plates 82, 84 (FIGS. 1 and 3) can be installed against the first and second sides 92, 94 of the door panel 90. The shaft 30 is then positioned within the spindle hole 32 of the latch bolt mechanism 18. If the notch 34 of the spindle hole 32 is not directed toward the face plate 24 of the handle assembly 10, the shaft 30 can be rotated to properly orient the notch 34 toward the face plate 24. Each of the outside and inside lever members 12, 14 are then slid onto the ends 36, 38 of the shaft 30 such that the lever members 12, 14 extend horizontally toward the center of the door panel 90. The set screws (e.g. 57) are then tightened to secure the lever members 12, 14 onto the shaft 30.

In operation, the lever members 12, 14 can be rotated in the first direction (typically downward) to control the opening and closing of the door. The lever members 12, 14 may also be rotated in the second opposite direction (typically upward) to the retained position. In the retain positioned, the lever members are retained or held in a position (typically a vertical position) away from the adjacent area of the door to provide access to the adjacent area even when the handles are released. This is advantageous in permitting a user to work hands-free of the lever members when maintaining the aesthetics of the adjacent area of the door panel, or when removing or installing storm windows or screens in the door panel.

The above specification provides a complete description of the DOOR HANDLE ASSEMBLY. Since many embodiments of the invention can be made without departing from the spirit and scope of the invention, the invention resides in the claims hereinafter appended.

What is claimed is:

1. A door handle assembly comprising:

a) a housing;

b) a latching mechanism positioned within the housing, the latching mechanism defining a through hole;

c) a cam mounted on said latching mechanism, said cam including a cam through hole aligned with the latching mechanism through hole, the cam having first and second operating surfaces extending away from the cam through hole and the latching mechanism through hole;

d) a shaft positioned within both through holes, the shaft having a first end and a second end;

e) a first lever handle mounted on the first end of the shaft in a first position, rotatable downward to a second position, and rotatable upward a third position, wherein rotation from the first position to the second position opens the latching mechanism with said cam second operating surface to permit opening of a door; and f) when said first lever handle is rotated upward to said third position, a retaining mechanism, positioned within the housing, holds the first lever handle in said third position, said retaining mechanism including a retaining catch driven by the first surface of said cam when said first lever handle is rotated to said third position.

2. The door handle assembly of claim 1, wherein the first lever handle rotates in a plane from the first position to each of the second and third positions.

3. The door handle assembly of claim 2, wherein the plane is parallel to a first side of a door when the latching mechanism is mounted between the first side and a second opposite side of the door.

4. The door handle assembly of claim 1, wherein the latching mechanism is configured to extend and retract a latch bolt interconnected to the latching mechanism, the latch bolt being extended when the first lever bandle is positioned in the first and third positions, the latch bolt being refracted when the first lever handle is positioned in the second position.

5. The door handle assembly of claim 1, wherein the first lever handle rotates in a first downward direction from a generally horizontal first position, and rotates in a second upward direction from the horizontal first position.

6. The door handle assembly of claim 5, wherein the first lever handle is oriented in a generally vertical orientation when the lever handle is rotated to the third position.

7. The door handle assembly of claim 5, wherein the first lever handle is configured to rotate a first number of degrees to the second position and a second number of degrees to the third position, the second number of degrees being greater than the first number of degrees.

8. The door handle assembly of claim 5, wherein the first lever handle is configured to rotate between 15 and 40 degrees to the second position and between 85 and 95 degrees to the third position.

9. The door handle assembly of claim 1, further including a second lever handle mounted to the second end of the shaft and configured to rotate in concert with the first lever handle.

10. The door handle assembly of claim 1 further including a stop projection within said latching mechanism, said second surface of said cain engaging said stop projection to limit the movement of said first lever handle when said first lever handle is moved to said seseed third position.

11. The door handle assembly of claim 1 wherein said retaining catch includes a detent extension engagable with said first cam surface.

12. The door handle assembly of claim 1 wherein said retaining catch is spring loaded against said cam.

13. A door handle assembly comprising:

a housing;

a latching mechanism positioned within the housing, the latching mechanism defining a through hole;

a shaft positioned within the through hole, the shaft having a first end and a second end;

a first lever handle mounted on the first end of the shaft in a first position and rotatable in a downward and an upward direction, wherein rotation in the downward direction moves the first lever handle from a first position to a second position and opens the latching mechanism to permit opening of the door, and wherein rotation in the upward direction moves the first lever handle from the first position to a third position, which passes the first lever handle over a retaining mechanism to hold the handle in the third position; and a rotation limiting means for limiting rotation of said first lever handle beyond said third position.

* * * * *